United States Patent [19]

Hinz

[11] 4,128,194

[45] Dec. 5, 1978

[54] CARRYING APPARATUS DETACHABLY MOUNTABLE ON CLOTHING AND OTHER FABRIC-LIKE MATERIALS

[76] Inventor: Gerhardt J. Hinz, McCord Apartments, #13, Denison, Iowa 51442

[21] Appl. No.: 572,416

[22] Filed: Apr. 28, 1975

[51] Int. Cl.[2] ..... A45C 1/04

[52] U.S. Cl. ..... 224/5 R; 24/263 R

[58] Field of Search ..... 224/5 R, 5 H, 26 R, 224/5 Q, 5 MA, 26 F; 24/3 F, 3 H, 3 L, 3 R, 263 HE, 263 FC, 263 SW, 263 R

[56] References Cited

U.S. PATENT DOCUMENTS

| | | | |
|---|---|---|---|
| 808,653 | 1/1906 | Hall et al. | 24/263 FC UX |
| 1,218,769 | 3/1917 | Hill | 24/263 HE |
| 1,440,690 | 1/1923 | McMosiman | 224/5 R UX |
| 2,081,930 | 6/1937 | Hoffman | 224/5 R |
| 2,089,221 | 8/1937 | Patur et al. | 24/263 FC X |

*Primary Examiner*—Trygve M. Blix

*Assistant Examiner*—Kenneth Noland

*Attorney, Agent, or Firm*—Williamson, Bains, Moore & Hansen

[57] ABSTRACT

A detachable pocket, pouch or container readily attachable to and detachable from clothing or other flexible, fabric-like materials without alteration of or damage to the material comprises a tongue member positionable wholly on one side of the fabric-like material with its periphery engageable against the material, a receiver member positionable against the remaining side of the material opposite the tongue member and having guideways adjacent its periphery to slidably engage the periphery of the tongue member to releasably retain the tongue member and grip the fabric-like material between the members so as to retain the members on the fabric-like material without damage to the material. One of the members carries a load device such as a container, pouch, adhesive surface or the like by which a load may be carried.

4 Claims, 8 Drawing Figures

CARRYING APPARATUS DETACHABLY MOUNTABLE ON CLOTHING AND OTHER FABRIC-LIKE MATERIALS

BACKGROUND OF THE INVENTION

Many garments and items of wearing apparel are not provided with any pockets in which a wearer may carry items he considers necessary or desirable to have on his person. For example, many sweaters, shirts and blouses have no pockets whatever, requiring the wearer to carry such items as eyeglasses, pens, cigarettes, checkbooks, wallets, credit cards and the like in some other less convenient manner, or alternatively to forego the convenience of having them available. Certain of these articles, such as cigarettes, eyeglasses or credit cards, are not easily carried in a trouser pocket, even when available, because of the likelihood of their being crushed or damaged. The traditional absence of pockets in most women's garments has long necessitated the carrying of a purse, and it would be desirable that some means be devised to eliminate the carrying of the purse at times and places where inconvenient.

In addition, many workers must carry tools on their jobs, and while the tools may be small enough to carry easily, they are often awkward or uncomfortable to carry in a standard garment pocket.

To meet these carrying needs, it would be desirable to have available a detachable pocket or carrying apparatus which may be easily attached to one's clothing without altering, cutting, piercing or otherwise damaging the fabric. In addition, it would be desirable to be able to easily detach the pocket from the garment when unneeded or to transfer it from garment to garment. A given garment could thus be provided with a pocket or carrying apparatus adapted to the particular need of the wearer and easily replaced by a different pocket when a different need arises. The present invention meets these needs with a new and novel, inexpensive and easily operated carrying apparatus.

SUMMARY OF THE INVENTION

The invention relates to the field of pockets or containers which are attachable to or detachable from clothing or other flexible, fabric-like materials without cutting, piercing or altering the fabric in any way.

The invention utilizes a tongue member positionable wholly on one side of the garment or other flexible, fabric-like material with its periphery engageable against the material. A receiver member is positioned on the opposite side of the material and opposite the tongue member and may be provided with a substantially flat face or plate which is flushly engageable against the material. The receiver member has means for encompassing the tongue member, such as a pair of guideways adjacent the periphery of the receiver, for slidably receiving the periphery of the tongue member. The tongue member and receiver member cooperate with one another to define a narrow gap therebetween in which the fabric-like material is captured, permitting the members to be releaseably attached to the material and retain themselves on the material without damage to the material. Locking means is provided on the members to retain the tongue member in the receiver member.

A variety of load devices may be attached to one or the other of the members. For example, the load device may comprise a rigid container for the protection of crushable objects such as eyeglasses or cigarettes. Alternatively, the load device may be a pouch or bag, a wallet or checkbook, or a tool-carrying container. The invention can accept a decal or badge as the load device if desired. By placing an adhesive layer on one of the members, a great variety of loads may be attached to the member by a user, thereby making the device extremely adaptable to a wide variety of different tasks, purposes and users.

The invention makes it possible to attach a pocket on substantially any garment or flexible, fabric-like material and to move it from one garment to another when necessary. The invention can be attached and detached without cutting, piercing, stretching, or altering the fabric-like material and used with materials having a wide range of thicknesses, ranging from relatively thin synthetic materials to fairly heavy, bulky woolens such as sweaters. The carrying apparatus may be mounted on knapsacks to provide additional pockets or pouches. It is extremely useful for the carrying of tools and accessories by a workman in that the invention is easily attachable to any garment or uniform and readily detachable so as to position the tools or accessories conveniently when the operator or workman is using them. The apparatus may be easily moved from place to place on a given garment to position it in the most convenient location for any given task.

The invention is extremely durable, compact, resistent to shock and rough handling, easy and inexpensive to manufacture, simple to use and highly reliable. These and other advantages will appear from the further description of the invention herein and from the drawings, in which like reference characters indicate like parts in the several views.

BRIEF DESCRIPTION OF THE DRAWINGS

FIG. 1 is a perspective drawing of an embodiment of the carrying apparatus invention shown mounted on a garment of a user.

FIG. 2 is an exploded perspective drawing of the embodiment shown in FIG. 1.

FIG. 3 is a cross-sectional top elevation view of the embodiment shown in FIG. 1 taken in the direction of arrows 3—3 in FIG. 1.

FIG. 4 is a cross-sectional side elevation view of the embodiment shown in FIG. 1 taken in the direction of arrows 4—4 of FIG. 1.

FIG. 5 is a perspective drawing of the carrying apparatus invention wherein a pouch or pocket is used therewith and is shown attached to a knapsack or backpack.

FIG. 6 is an exploded perspective drawing of a second embodiment of the carrying apparatus invention.

FIG. 7 is a cross-sectional side elevation view of a portion of the embodiment shown in FIG. 6 showing the tongue member in retained position on the receiver member with the embodiment mounted on a garment or the like.

FIG. 8 is a cross-sectional top elevation view of a portion of the embodiment shown in FIG. 6 showing the embodiment mounted on a garment or the like.

DESCRIPTION OF THE PREFERRED EMBODIMENTS

Figures 1, 2, 3, 4, 5, 6, 7, 8:
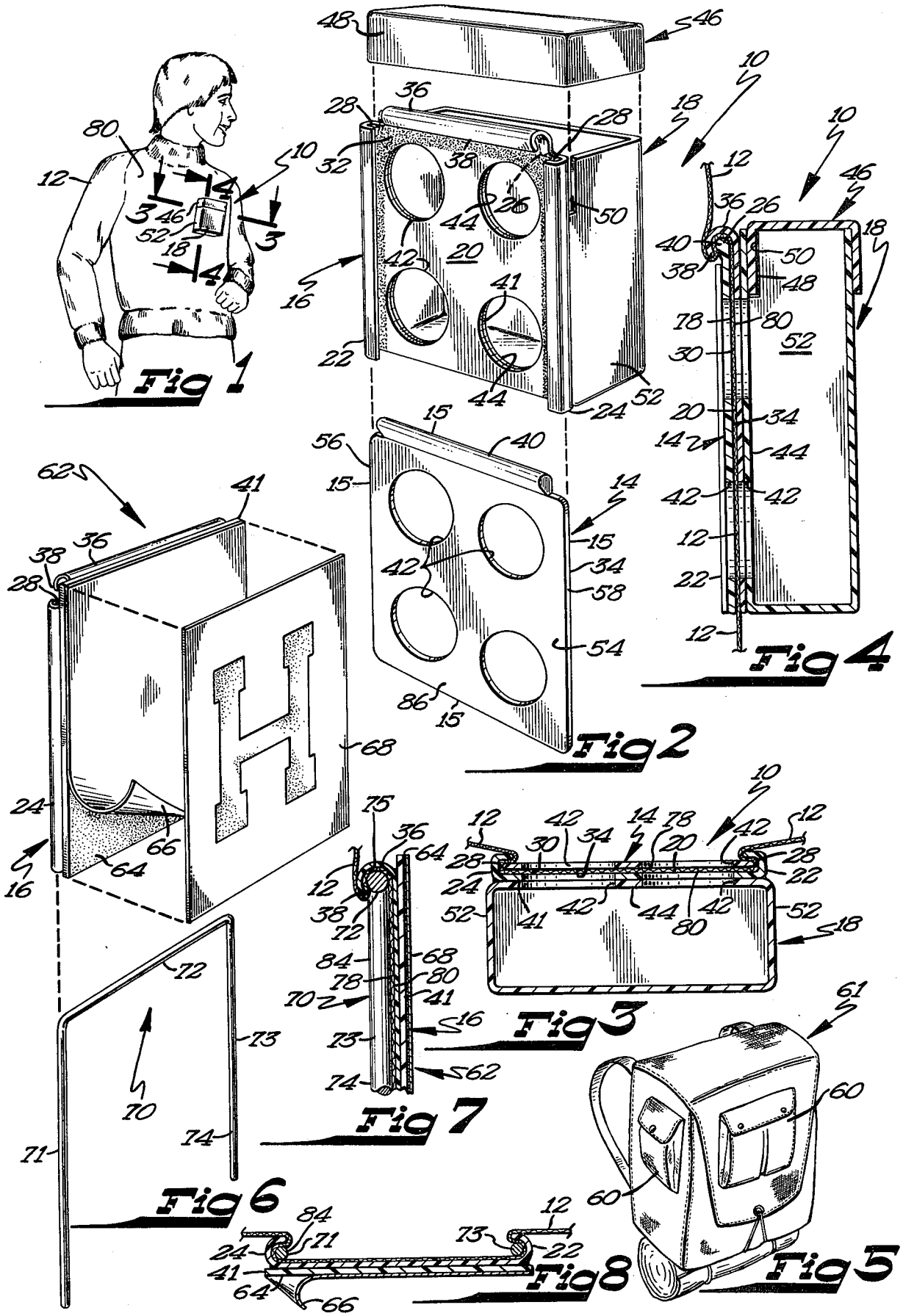

Referring now to FIG. 1, a detachable carrying apparatus 10, embodying the invention, is shown attached to the garment 12 of a user in a manner described in further detail hereafter. While the apparatus 10 is here shown as attached to a shirt or sweater-like garment, it should be understood that the apparatus may be just as readily attached to trousers, coat, rain gear or substantially any other flexible, fabric-like material without cutting, piercing or altering the material in any way, making it easily transferrable from one garment to another or movable from place to place on the same garment. The term flexible, fabric-like material, as used herein, is intended to include any commercially available or hereafter developed fabric from which clothing may be made and any nylon, vinyl, plastic, plastic-like material or canvas-like material to which the invention can be attached.

The carrying apparatus 10 utilizes a tongue member 14 and receiver member 16, the receiver member carrying a load device such as the crush-resistant box 18, which is well adapted for the carrying of cigarettes.

The receiver member 16 has a face 20 flushly engageable with the fabric-like material 12 and from which, in the shown embodiment 10, a pair of spaced apart guideways or tracks 22 and 24 extend outwardly. These tracks or guideways comprise a means for encompassing at least part of the periphery 15 of the tongue member 14 when the member 14 is slidably inserted within the tracks 22 and 24 into the retained position 26, shown in FIGS. 2 and 4. Although it is preferred that the tongue member and receiver member be generally rectangular in shape with the tracks 22 and 24 being parallel to one another, such geometry is not essential, and other shapes and other orientations of the tracks which permit retention or encompassing of the tongue member 14 by the receiver member 16 are contemplated and are within the purview of the invention.

While the shown guideways or tracks represent one means for encompassing a part of the periphery of the tongue member, it should be understood that alternative structures may be substituted for the guideways, and all such alternatives as would be obvious to one skilled in the art are within the purview of the invention.

The guideways or tracks 22 and 24 contain and guide the tongue member 14 therebetween and are shaped to allow ample clearance between the inner side 28 of each guideway and the adjacent periphery 15 of tongue member 14 to define a narrow gap 30 (FIG. 3) in which a layer of fabric-like material 12 may be captured without damage to the material, permitting the tongue and receiver members to be easily, releasably attached to the fabric-like material. If desired, an irregular, abrasive or roughened surface having a series of raised, material-engaging protuberances, stippling 32 or the like for frictionally engaging the material 12, may be provided on the otherwise substantially flat face 20 and also, if desired, on the confronting face 34 of the tongue member 14 to better grip the fabric-like material 12 therebetween and further discourage slippage or movement of the apparatus 10 relative to the material.

At one end of the receiver member 16 a keeper 36 extends outwardly from the face 20 and is positioned generally transversely to the already described tracks or guideways 22 and 24. The keeper 36 includes an inwardly curving hook section 38 (FIG. 4) which cooperates with a thickened rib 40 extending along one edge of the tongue member 14 to keep the tongue member in the retained position 26 on the receiver member 16. In the retained position 26, the rib 40 and keeper 36 trap or capture the fabric 12 therebetween, and the hook 38 curves sufficiently toward the face 20 to catch and retain the thickened rib 40 and prevent the tongue member 14 from slipping out of the keeper unless the tongue member is manually disengaged by the user. The keeper 36 and rib 40 thus cooperate to define a locking means for keeping the tongue member in the retained position 26.

A plurality of ventilation apertures 42 are formed in the face 20 of the receiver member and also in the tongue member. These apertures communicate in order to permit body moisture to pass therethrough and escape, thereby making the carrying apparatus 10 more comfortable to the user.

The receiver member 16 carries a load device on its face 41, here shown as the crush-resistant container 18, the container 18 being secured to the face 41 in any known manner, glue or adhesive material being preferred. While the embodiment 10 shows the container 18 as being glued to the face 41, it should be understood that the container 18 may be formed as an integral part of the receiver member 16 with the walls of the container 18 being integral with and extending outwardly from the plate 41, thereby eliminating the additional wall 44 of the shown container 18.

A container lid 46 fits securely over the open top of the container 18 with its side 48 slipping into a slot 50 in each sidewall 52 of the container. While a particular type of container has been shown in FIGS. 1–4 as being usable with the invention, it should be understood that a variety of container styles, colors and sizes, as well as other alternative load devices, some of which are described hereafter, may be used on either member 14 or 16 and are within the purview of the invention.

Referring now to FIGS. 2–4, the tongue member 14 includes a generally flat plate 54 and a thickened rib 40 extending transversely across the plate 54, the rib cooperating with the already described slot or keeper 36 to lock the tongue member in retaining position 26 on the receiver member 16. The tongue member 14 is preferably of rectangular construction with the peripheral edges 56 and 58 slidably receivable into and along the opposed and confronting tracks 22 and 24, respectively. If desired, a plurality of ventillation apertures 42 may be formed in the plate 54 to permit body moisture to pass from body surfaces through the apertures 42 of the tongue member 14 and then through the communicating apertures 42 in the receiver member 16, permitting the moisture to escape and making the carrying apparatus 10 more comfortable to the user.

The load device 18 is particularly useful for the protection and containment of easily crushable materials, such as eyeglasses or cigarettes. If desired, a fabric-type pocket 60 (FIG. 5) may be substituted for the container 18 where an expandable, but non-rigid pocket is desired. The pocket 60 may be attached to the surface 41 of the receiver member 16 by any means known to the art, such as by adhesive bonding, and the thus created carrying apparatus may be attached to the clothing of a user, to a knapsack 61 or to other appropriate items. While the pocket 60 and box 18 have been thus far described as being attached to the surface 41 of the receiver member, it should be understood that, if desired, these load devices or others may be attached instead to the plate 54 of the tongue member 14 with satisfactory results being obtained.

Referring now to FIGS. 6–8, a second embodiment 62 of the invention utilizes a receiver member 16 substantially identical to the receiver member described in FIGS. 2–4, but having a load device comprising an adhesive layer 64 affixed to the surface 41 of the member 16. The adhesive layer 64 is a commercially available adhesive and generally would be supplied with a paper covering 66 which is easily removable by peeling to expose the adhesive 64 and when in place on the material 12, preventing the material from unwanted adherence to surfaces. Accordingly, the adhesive layer 64 comprises one kind of load device which may be carried by the receiver member 16 and to which a variety of loads may be attached by an operator.

For example, if the operator wishes to attach a high school letter, badge-like object, or identifying indicia to the surface 41, he need only remove the paper covering 66 and press the letter 69 or other indicia into firm engagement with the adhesive material 64. A wide variety of emblems, badges or other indicia may thus be easily attached to the surface 41, and accordingly any carrying apparatus described herein may carry such a load device for display on the clothing of a user. While the letter 68 has been shown as attachable to the layer 64, it should be understood that, if desired, a container such as the box 18 or alternatively a pocket 60 may instead be attached to the surface 41 by means of the adhesive layer 64.

The embodiment 62 differs from the embodiment 10 in that the tongue member 70 used with the embodiment 62 is a rod 74 having three segments 71, 72 and 73 and may be formed of metal, plastic or any other appropriate material.

The thickness of the rod 74, which is preferably constant throughout its length, is selected such that when the rod 74 is in retaining position in the receiver member 16 with segment 71 positioned within track 24, segment 73 in track 22, and segment 72 in slot or keeper 36, the segments 71 and 72 cooperate with the tracks 22 and 24, respectively, to define gaps 75 between the segment and the inside surface 28 of each track in which the fabric-like material 12 may be captured. The keeper 36 includes a hook section 38, described earlier, which grips the rod segment 72 and the material 12 thereabout, and the keeper and segment 72 define a locking means for retaining the tongue member 70 in the receiver member 16. While the receiver and tongue members may be made of a variety of materials, it is preferred that they be molded of plastic or plastic-like material.

In operation, when a wearer wishes to attach the carrying apparatus 10 to a garment or other item made of flexible, fabric-like material, he first grasps the tongue member 14 and presses its surface 34 against the reverse surface of the fabric-like material 12 to which the apparatus is to be attached. For purposes of illustration, the garment surface against which the surface 34 is applied has been described as the reverse surface 78, although it should be understood that the surface 34 of tongue member 14 may just as readily be applied against the obverse surface 80 of the material 12. While with one hand the user holds the surface 34 of tongue member 14 flushly against the reverse surface 78 of the material 12, which with the sweater or shirt of FIG. 1 would be the inner surface of the garment, the user then grips the receiver member 16 with his other hand, and placing the receiver member on the obverse side 80 of the garment and just above the position of the tongue member, slides the receiver member 16 downwardly over the material 12 and over the peripheral side edges of tongue member 14 such that the material 12 is trapped or captured between the tongue member 14 and the receiver member 16. As the receiver member 16 moves relative to the tongue member 14, the tongue member, closely surrounded by the material 12, is guided along the face 20 of the receiver member with the lateral edges 56 and 58 of the tongue member 14 being within and sliding along the tracks 22 and 24, respectfully, which encompass edges 56 and 58 of the tongue member and also the intervening 12. The operator continues to slide the receiver member 16 along the tongue member until the rib 40 of the tongue member and a layer of material thereabout moves within the keeper 36 and is retained therein by the locking interaction between the rib 40 and hook section 38 of keeper 36. The tongue member 14 is now in retained position 26 (FIG. 4) with the garment 12 captured or trapped therebetween, as best shown in FIGS. 3 and 4. In this position 26 the carrying apparatus 10 is firmly but releasably retained on the garment and will not pull off or detach of its own volition. The stippled surfaces 32 bear against the material 12 and further discourage movement of the garment relative to the members 14 or 16, causing the carrying apparatus 10 to better adhere to the garment.

To remove the carrying apparatus 10 from the material 12, the user grasps the receiver member 16 in one hand and then reaches within the shirt or garment 12 with the remaining hand to hold the tongue member 14. He then slides the tongue member 14 downwardly relative to the receiver member, or alternatively holds the tongue member 14 stationary and slides the receiver member upwardly relative to the tongue member. By such movement, the tongue member slides out of the encompassing means formed by tracks 22 and 24, thereby separating the tongue and receiver members, which are then removed from the garment 12.

When in retained position 26, the ventilation apertures of the tongue member 14 communicate substantially directly with the apertures 42 of the receiver member 16, and accordingly body moisture of the user passes freely through the communicating apertures and is not trapped between the carrying apparatus 10 and the user. This makes the wearing of the apparatus 10 substantially more comfortable.

The operation on the second embodiment 62 is very similar to that described for the embodiment 10. When the tongue member 70 is in retained position 84 on the receiver member 16, the legs 71 and 73 are encompassed by the tracks 22 and 24, respectively, with the material 12 being captured or trapped therebetween, as best shown in FIG. 8. The segment 72 is retained in the keeper 36 by hook section 38, with the garment 12 closely surrounding the segment 72 and trapped between the segment 72 and the keeper 36. Preferably the keeper 36 is sized to closely engage the segment 72 when material 12 is interposed between the segment and the keeper 36.

Accordingly, the invention in its two described embodiments 10 and 62 may be easily and quickly attached to substantially any garment or flexible fabric-like material and may be moved from place to place on a given garment or material or transferred from one garment or material to another to suit the needs and desires of the user. Its use is not confined to garments alone, and the carrying apparatus may be placed on knapsacks, tarpaulins, curtains or the like where a pouch or container is deemed useful. While several specific load devices such as the container 18, the pocket 60, or the emblem, badge or identifying indicia 68 have been shown as being used with the invention, it should be understood that other alternative load devices consisting of special purposes containers and the like may be substituted and are within the purview of the invention.

Other contemplated uses of the invention include the substitution of wallet or checkbook as the load device. Alternatively, the load device may be a case for eyeglasses or a special compartmentalized case for special tools needed by an artisan. The carrying apparatus may be mounted to skirts, trousers or the like and may be positioned on the inside or the inner or outer face of the material, depending upon the needs of the user.

While the load device such as the container 18 or pocket 60 has been shown in the present disclosure as carried by the receiver member 16, it should be understood that the load device could as readily have been carried by the tongue member 14 and positioned on the face 86 of plate 54 thereof. If desired, the receiver member 16 may be positioned on the reverse surface 78 of the garment and the tongue member on the obverse surface 80 without affecting the efficiency or effectiveness of the invention. Still further, while the carrying apparatus has been shown as having tracks or slots 22 and 24 which are in a generally upright or vertical orientation, it should be understood that the tracks or slots may be oriented horizontally, or alternatively may remain in a vertical orientation and the keeper 36 positioned at the bottom instead of at the top of member 16 without affecting the efficiency of the invention.

The carrying apparatus invention disclosed herein thus provides an excellent solution to the need for additional pocket space or means for carrying necessary or desirable articles by a user, and may be readily attached to and detached from any garment or fabric without cutting, piercing, or damaging the fabric-like material. The apparatus is usable on materials having a wide range of thicknesses ranging from very thin materials to thickened, heavy, knitted materials.

While the preferred embodiments of the present invention have been shown and disclosed herein, it should be understood that various changes, adaptations and modifications may be made therein without departing from the spirit of the invention and the scope of the appended claims.

What is claimed is:

1. In combination with a flexible, fabric-like material having obverse and reverse sides, a carrying apparatus attachable to and detachable from said flexible, fabric-like material without damage to the integrity of said material, comprising:

a tongue member positionable wholly on the reverse side of said material and having a periphery engageable against the reverse side of said material;

a receiver member engagable against the obverse side of said fabric-like material opposite said tongue member and including means for encompassing at least part of the periphery of said tongue member to releasably retain said tongue member adjacent said receiver member in a retained position wherein said receiver member cooperates with said tongue member to define a narrow gap therebetween in which said fabric-like material is captured, permitting said members to be releasably attached to the fabric-like material so as to be firmly retained on the material without damage to the material;

a load device carried by one of said members;

said tongue member and said receiver member having generally rectangular peripheries and said encompassing means of said receiver member including a pair of spaced-apart, parallel tracks adjacent opposed edges of said receiving member for slidably receiving said tongue member in said tracks;

a keeper on said receiver member positioned between said parallel tracks to receive and releasably engage said tongue member; and said tongue member including a rib confronting and releasably engaging said keeper to thereby releasably lock said tongue member within said keeper, with said fabric-like material being retained between said rib and said keeper.

2. The carrying apparatus of claim 1 wherein said rib and said keeper cooperate to define a gap therebetween in which said fabric-like material is closely confined to retain said members on said material.

3. A carrying apparatus detachably mountable on obverse and reverse sides of a flexible, fabric-like material to carry a load without damage to the integrity of the fabric-like material, comprising:

a tongue member positionable wholly on the reverse side of the material and having a periphery engagable against the reverse side of the fabric-like material;

a receiver member engagable against the obverse side of the material opposite said tongue member and including means for encompassing at least part of the periphery of said tongue member to releasably retain said tongue member adjacent said receiver member in a retained position wherein said receiver member cooperates with said tongue member to define a narrow gap therebetween in which the fabric-like material is capturable, permitting said members to be releasably attachable to and detachable from the fabric-like material without damage to the fabric-like material;

a load device carried by one of said members;

locking means on said members to selectively retain said tongue member in said receiver member, said locking means, when engaged, preventing movement of said tongue into and out of said receiver member;

said locking means including a keeper on said receiver member to receive and releasably engage said tongue member; and said tongue member including a rib confronting and releasably engaging said keeper to thereby releasably lock said tongue member within said keeper, with said fabric-like material being retained between said rib and said keeper.

4. In combination with a flexible, fabric-like material having obverse and reverse sides, a carrying apparatus attachable to and detachable from said flexible, fabric-like material without damage to the integrity of said material, comprising:

a tongue member positionable wholly on the reverse side of said material and having a periphery engageable against the reverse side of said material;

a receiver member engageable against the obverse side of said fabric-like material opposite said tongue member and including means for encompassing at least part of the periphery of said tongue member to releasably retain said tongue member adjacent said receiver member in a retained position wherein said receiver member cooperates with said tongue member to define a narrow gap therebetween in which said fabric-like material is captured, permitting said members to be releasably attached to the fabric-like material so as to be firmly retained on the material without damage to the material;

a load device carried by one of said members; and said tongue member being generally flat, and said members having communicating ventilation apertures therethrough to permit body moisture from a wearer to escape through said apertures.

* * * * *